United States Patent [19]

Kronseder

[11] Patent Number: 5,024,348

[45] Date of Patent: Jun. 18, 1991

[54] MAGAZINE ASSEMBLY FOR LABELS OR THE LIKE IN A LABELING MACHINE

[76] Inventor: Hermann Kronseder, Regensburger Strasse 42, D-8404 Wörth/Donau, Fed. Rep. of Germany

[21] Appl. No.: 218,990

[22] Filed: Jul. 14, 1988

Related U.S. Application Data

[60] Division of Ser. No. 97,323, Sep. 11, 1987, Pat. No. 4,799,605, which is a continuation of Ser. No. 824,648, Jan. 31, 1986, abandoned.

[30] Foreign Application Priority Data

Feb. 2, 1985 [DE] Fed. Rep. of Germany ..... 3503621
Jul. 13, 1985 [DE] Fed. Rep. of Germany ..... 3525035
Oct. 11, 1985 [DE] Fed. Rep. of Germany ..... 3536294

[51] Int. Cl.[5] ..... B65H 1/30

[52] U.S. Cl. ..... 221/11; 221/198; 271/157; 414/417

[58] Field of Search ..... 221/11, 104, 106, 198; 414/119, 403, 404, 413, 414; 271/157; 156/DIG. 29

[56] References Cited

U.S. PATENT DOCUMENTS 3,861,543 1/1975 Elsworth ..... 414/414 X
3,915,338 10/1975 Kronseder et al. ..... 221/198 X
4,618,305 10/1986 Cedrone et al. ..... 414/403
4,653,665 3/1987 Heisner et al. ..... 221/11

*Primary Examiner*—F. J. Bartuska
*Attorney, Agent, or Firm*—Finnegan, Henderson, Farabow, Garrett & Dunner

[57] ABSTRACT

A magazine assembly for labels having a main magazine for feeding the labels to a take-out location, a stationary support disposed rearwards thereof for retaining a replaceable supply magazine in alignment with the main magazine, the support having a lateral entry opening for a full supply magazine and an exit opening for an empty supply magazine. Connected to the entry opening is storage for a plurality of full supply magazines, from which the supply magazines may be fed onto the support through the entry opening. Adjacent the exit opening is a cam stop for holding the supply magazine in position for supplying labels to the main magazine.

13 Claims, 3 Drawing Sheets

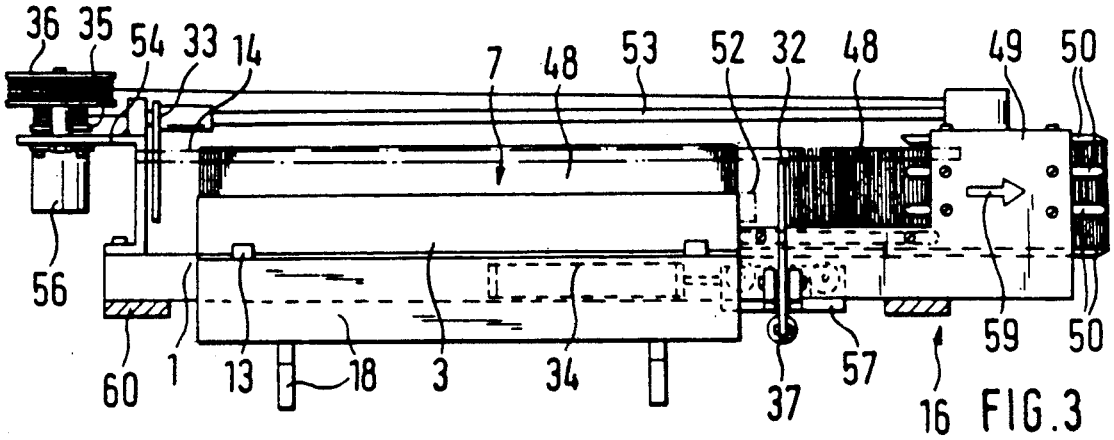
FIG.3
FIG.4
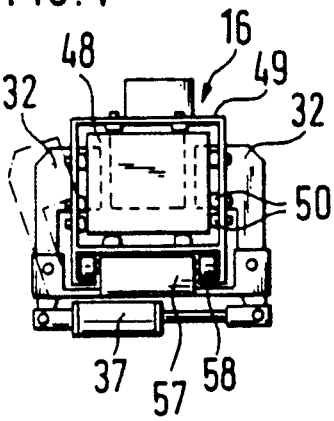
FIG.5
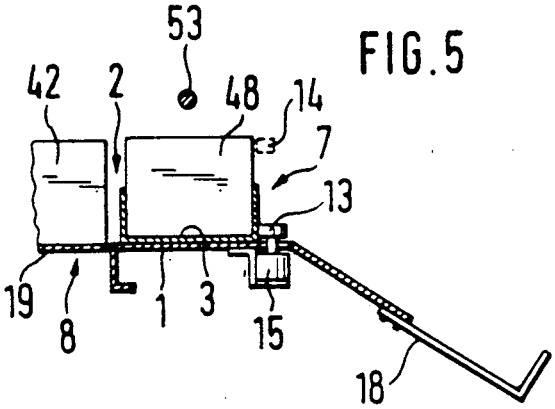
FIG.6
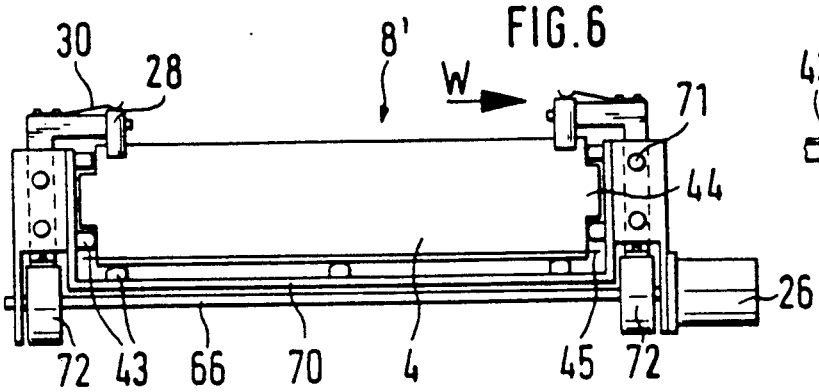
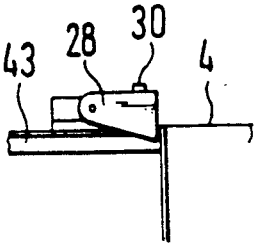
FIG.7

MAGAZINE ASSEMBLY FOR LABELS OR THE LIKE IN A LABELING MACHINE

This is a division of application Ser. No. 097,323, filed Sept. 11, 1987 which is a continuation of Ser. No. 824,648, filed Jan. 31, 1986 now abandoned.

BACKGROUND OF THE INVENTION

The present invention relates to a magazine assembly for labels or the like in a labeling machine, comprising a main magazine provided with feed means for advancing the labels to a take-out position, and having connected thereto a support for a replaceable supply magazine in alignment with said main magazine, said support having one of its longitudinal sides formed with an entry opening for a full supply magazine, and another side, with an exit opening for an empty supply magazine, said entry opening communicating with a supply feed path adapted to contain a plurality of supply magazines.

A magazine assembly of the type defined above is known from DE-OS No. 21 53 169. The supply magazines are of rectangular cross-sectional shape and are fed to the support in the horizontal direction transversely of their longitudinal axis. For the transfer of their contents they are in alignment with the main magazine. Subsequently they are discharged from the assembly through the exit opening formed in a longitudinal side opposite the entry opening. Provisions for fixing the supply magazine in the support are not specified. The same applies to the automatization of the replacing operation.

Also known already is a magazine assembly in which the main magazine is composed of guide rails and substantially shorter than the trough-shaped support, or a likewise trough-shaped supply magazine supported therein (DE-OS No. 23 03 547). In this embodiment, the supply magazine acts as a guide for the labels over the length of the support, until the labels have been successively transferred into the main magazine by a feed means comprising a pair of pusher members. The supply magazine has thus to remain in the support until completely emptied. The length of this known magazine assembly is scarcely greater than that of a conventional label container, and the assembly is of very compact construction, so that a multiple arrangement in a labeling machine for the multiple labeling of bottles does not offer any difficulties. The known magazine assembly also provides for a noticeable facilitation for the operator, as it enables him to replenish the device with several thousand labels in a single operation. In addition, the subdivision of the magazine assembly into a main magazine fixedly connected to the labeling machine and having the important function of guiding the labels immediately before their being taken out, and a replaceable supply magazine having the less important function of guiding the labels in the rear portion of the magazine assembly, permits the employ of different types of supply magazines including embodiments thereof serving as a packing or shipping container from the label supplier to the label consumer.

There is a certain disadvantage, however, due to the fact that the rigid mounting of the lateral stops or guides for a supply magazine in the support permits a full supply magazine to be inserted into the support only from above and/or from the rear, and an empty magazine to be removed from the support only substantially upwards and/or rearwards. Particularly the insertion of a full supply magazine may, due to the considerable weight thereof, cause certain difficulties to the operator, moreover as this operation is not aided by any provisions for this purpose. This procedure for inserting and removing the supply magazines also constitutes an obstacle to a further facilitation or automatization of the replacement operation.

On the other hand, there is already known a label magazine assembly comprising a main magazine fixedly connected to a labeling machine and a replaceable supply magazine having substantially the same length, wherein the support is formed by a turntable disposed to the rear of the main magazine (DE-OS No. 21 45 508). Along its üeriphery the turntable carries a plurality of supply magazines which may also serve as shipping containers. After the supply magazine aligned with the main magazine has been completely emptied by a pusher member acting as the feed means, the turntable is indexed by an angular step for aligning a full supply magazine with the rear end of the main magazine. In this manner the work of the operator of the labeling machine is facilitated, and the replacement operation is capable of being automatized to a large extent.

A disadvantage, however, of this known magazine assembly is the highly complicated construction and the space requirement of the turntable including its drive and control arrangements, which acts as an obstacle to employ a multiple arrangement for the multiple labeling of bottles or the like. For this reason the described magazine assembly has not been accepted by the trade. In this context it is to be noted that a storage device for storing a plurality of supply magazines does not substantially shorten the overal time required for the replenishment of labels by the operator, because each supply magazine has still to be filled with labels or, in the case of the supply magazine being used as the shipping container, it has to be removed from its outer packing, and securing means possibly provided for safe shipping have to be released, before the supply magazine can be mounted on the turntable or other storage device. The described construction is rather effective to decisively extend the period between successive storage device filling operations, i.e. the buffer interval during which the operator is able to carry out various other operations. It is obvious that the label-processing industry is not prepared to invest relatively great sums for merely extending this buffer interval.

It is therefore an object of the present invention to improve a magazine assembly of the type defined in the introduction by simple means and so as to substantially retain its compact construction, to thereby substantially facilitate the task of the operator and to provide for the possibility of automatization of the replacement of the supply magazine.

SUMMARY OF THE INVENTION

In the magazine assembly according to the invention, the supply feed path permits a plurality of filled supply magazines to be held at the ready immediately adjacent the support, the described construction permitting the operator to insert filled supply magazines at any suitable time. When an empty supply magazine has to be replaced, a filled supply magazine is inserted through the lateral entry opening, and at the same time the empty supply magazine is ejected through the exit opening at the opposite side, preferably by direct contact with the full supply magazine replacing it. During this operation, the rigid stop engaging the labels, or the retractable stop, respectively, engaging the supply magazine, are effective to ensure that the new supply magazine is retained at its proper lateral position in alignment with the main magazine. On the other hand, the specific construction of these stops avoids any interference with the ejection of the empty supply magazine. The replacement operation can thus be carried out rapidly and in a simple manner either manually or automatically. The overall length of the magazine assembly is not increased by the supply feed path, and also the increase in width remains within acceptable limits with a sufficient capacity of six to ten full supply magazines. A particular conveyor for the ejected empty supply magazines is not either required, as the empty magazines may be directly ejected into a collecting receptacle or the like. There are thus no major attachments on the exit opening side of the magazine assembly, so that the assembly is readily accessible from this side.

In order to reduce the floor space requirements of the magazine assembly without loss of storage capacity, and at the same time for simplifying its operation, an advantageous aspect of the invention provides that the supply feed path extends vertically. In this embodiment, the supply feed path may comprise a substantially vertical supply shaft in which the supply magazines are stacked above one another with their longitudinal axes oriented horizontally. The basis area required by the supply shaft is scarcely greater that that of a supply magazine, while the height of the supply shaft may be dimensioned so as to obtain any suitable capacity. This is because there is usually sufficient space available above a labeling machine. The access to components of the labeling machine disposed at lower levels is not obstructed by the supply feed path. In addition, the advance movement of the supply magazines through the supply shaft is brought about by the effect of gravity alone, so that there are no long-stroke conveyor means required for this purpose. The construction of the supply shaft is extremely simple, resulting in low investment costs. In addition, a fully automatic operating mode can be accomplished by simple means. The supply shaft can be employed for magazine assemblies of different construction, independently of the manner in which the supply magazines are introduced into the support, in which manner they are retained in the support, and in which manner the empty supply magazines are removed from the support. It is likewise irrelevant whether the magazine assembly is operated manually or operates more or less automatically. In each case, the vertical supply shaft with the supply magazines stacked therein obove one another permits a spectacular supply of labels to be maintained on a minimum basis area immediately adjacent the magazine assembly.

DESCRIPTION OF THE DRAWINGS

Several embodiments of the invention shall now be described by way of example with reference to the accompanying drawings, wherein:

FIG. 3 is an elevational view in the direction "Y" of FIG. 1;

FIG. 4 is a partial elevational view in the direction "X" of FIG. 1;

FIG. 5 is a sectional view taken along the lines IV—IV of FIG. 1;

FIG. 6 is a partial elevational view in the direction "Z" of FIG. 1 modified for use with a different supply magazine;

FIG. 7 is a partial view in the direction "W" of FIG. 6;

DETAILED DESCRIPTION OF THE INVENTION

Figure 1:
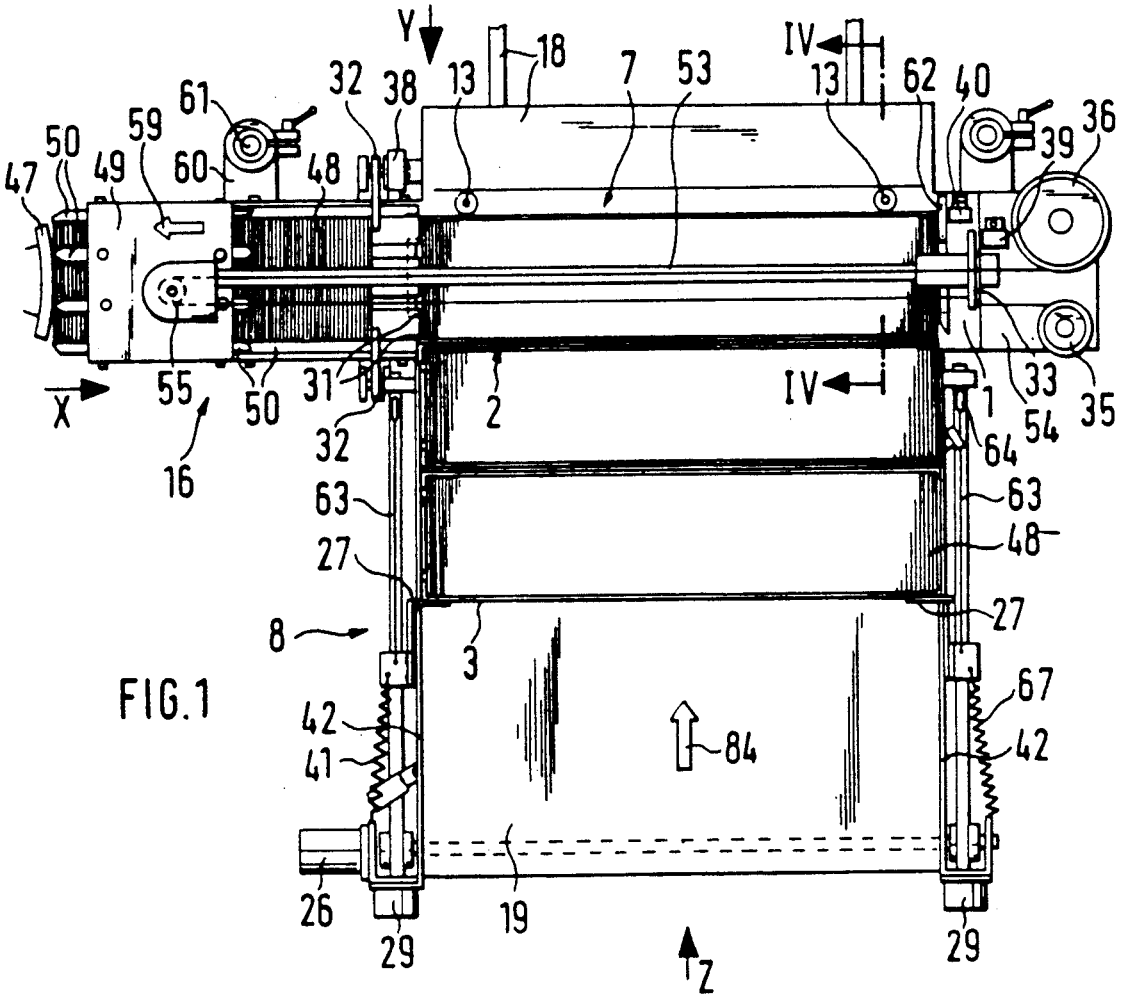
FIG. 1 shows a top plan view of a label magazine assembly in a labeling machine.
Figure 2:
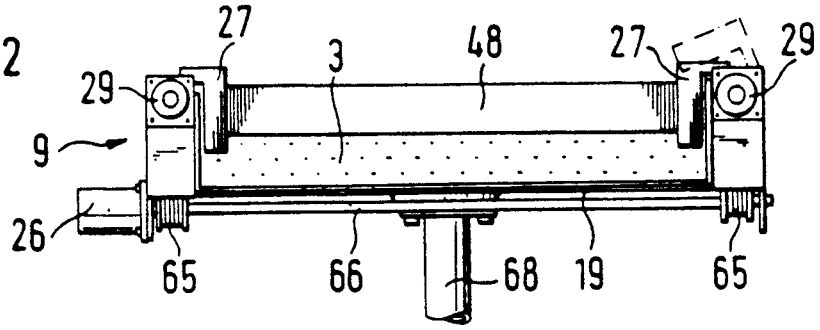
FIG. 2 is a partial elevational view in the direction "Z" of FIG. 1.

The magazine assembly shown in FIGS. 1 to 5 is integrated in a bottle labeling machine (not shown in detail), in which labels 48 are taken from a stationary stack by means of glued transfer plates 47. The magazine assembly comprises a main magazine 16 composed of a frame 49 and a plurality of guide rails 50 for accurately feeding labels 48 to the take-out location. Two bottom guide rails 50 and lower lateral guide rails 50 are of extended length with respect to the others in the direction away from the take-out location so as to define an engagement space for a pair of label pushers 32 and 33. The rear end faces 31 of the extended guide rails 50 facing away from the take-out location additionally serve as a stop for a replaceable supply magazine 3 so as to define the forward end position thereof in a support 1 fixedly connected to main magazine 16. Support 1 extends from a location immediately adjacent the rear end of main magazine 16 and is provided with a horizontal base plate 11.

The lefthand longitudinal side of support 1, as seen in the feed direction of labels 48, is formed with an upwards open entry opening 2 for full supply magazines 3. Otherwise this side of support 1 is not provided with any lateral fixing elements for a supply magazine 3. The opposite righthand longitudinal side of support 1 is formed with an exit opening 7 for empty supply magazines 3, the height of the exit opening being limited by a guide rail 14. Entry opening 2 and exit opening 7 are disposed diametrally opposite one another, and are each somewhat longer than supply magazine 3. For accurately positioning supply magazine 3 in a transfer position aligned with main magazine 16 two cam members 13 are provided adjacent exit opening 7 for lateral engagement of supply magazine 3 and adapted to be retracted to a position below the bottom of support 1 by means of an actuator 15. The transfer position of supply magazine 3 is additionally defined by guide rail 14 extending over the full length of support 1 so as to engage the labels 48 stacked in supply magazine 3. In FIGS. 3 and 5 guide rail 14 is indicated by dash-dot lines. The fixation by guide rail 14 is only effective as long as there are labels 48 in supply magazine 3. The employ of guide rail 14 is not always possible with labels and supply magazines of different shapes. On the other hand, its employ may in some cases render the provision of movable cam members 13 or the like superfluous.

Figure 8:
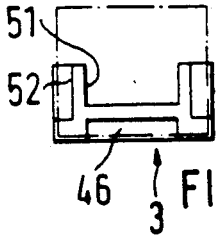
FIG. 8 is an end view of a cardboard supply magazine for body labels.

In the embodiment shown, supply magazines 3 serve as shipping containers and are made of cardboard. They are of trough-shaped construction with one end closed by a wall having a cutout portion 51 for a label pusher 33 to extend therethrough. The other end is open and provided with lateral flaps 52 and a bottom flap 46. (See FIG. 8) Flaps 46 and 52 serve for securely retaining the labels in the supply magazine during transport and also during insertion into support 1 of the magazine assembly. When the labels are pushed out by label pusher 33, flaps 46 and 52 are automatically flipped open, whereby bottom flap 46 comes to repose on bottom guide rails 50 so as to ensure a smooth transfer of the labels from supply magazine 3 into main magazine 16. Stops 31 are engaged with end portions of supply magazine 3 not provided with flaps. Supply magazine 3 is already filled with labels at the label manufacturer's plant, an additional protection in the form for instance of a shrink foil being provided for shipping and storage. This additional protection is removed prior to insertion into the magazine assembly.

The magazine assembly is provided with two independent label pushers 32 and 33 both of which are displaceable in the feed direction. One of the pushers, the so-called main pusher 33, travels over the full length from main magazine 16 to the rear end of supply magazine 3. It is slidably guided on a rod 53 extending above support 1 and mounted at one end on frame 49 and at the other end in a mounting support 54 located at the rear end of support 1. A spring-loaded sheave 36 carried by mounting support 54 has a first cable secured thereto and wound thereonto. This cable extends around a return sheave 55 mounted on frame 49 and has its distal end secured to pusher 33. Spring-loaded sheave 36 thus acts in the conventional manner for feeding the labels. Also mounted on mounting support 54 is a cable drum 35 operatively connected to a motor 56. A cable secured to and wound on cable drum 35 has its distal end directly secured to main pusher 33. Cable drum 35 may thus be rotated by motor 56 for returning main pusher 33 to its rear end position against the force of spring-loaded sheave 36 acting thereon in the feed direction.

The other label pusher 32, the so-called auxiliary pusher, travels only along the rearward portion of main magazine 16. It comprises a pair of blades engaging the labels laterally of main pusher 33 and mounted on a carriage 57 for pivotal movement transversely of the feed direction. Carriage 57 is accurately guided in the feed direction by four wheels 58 running in channel-shaped guides at the lower side of main magazine 16. Carriage 57 is connected to a double-acting pneumatic cylinder 34 operable to displace auxiliary pusher 32 selectively in the feed direction or opposite thereto. Actuator arms associated with the blades are interconnected by a further double-acting cylinder 37 selectively operable to bring auxiliary pusher 32 into and out of engagement with labels 48 in main magazine 16.

Connected to exit opening 7 of support 1 is a simple collecting device 18 for ejected empty supply magazines 3, comprising a short downwards sloping chute with a stop bracket at its lower end. The collecting device 18 together with the other previously described components of the magazine assembly, such as main magazine 16, support 1, main pusher 33, auxiliary pusher 32 etc. forms an integral structural unit mounted by means of a pair of clamping brackets 60 on a pair of vertical columns 61 of the labeling machine for vertical adjustment therealong. Columns 61 themselves are part of a label carriage (not shown) mounted for displacement between a take-out position, in which transfer plates 47 are operable to take the foremost label 48 from main magazine 16, and a neutral position slightly retracted from the orbit of transfer plates 47.

Extending from entry opening 2 of support 1 at right angles to the feed direction of labels 48 is a slideway 8 having a bottom plate 19 and a pair of parallel lateral guide walls 42. Slideway 8 is adapted to support a plurality of supply magazines 3 extending parallel to the feed direction in contact with one another. Guide walls 42 are effective to accurately align the supply magazines 3 and to additionally prevent labels 48 at the ends thereof from dropping out or being damaged. Bottom plate 19 extends in a common plane with the smooth bottom of support 1, so that supply magazines 3 are able to smoothly enter support 1 from slideway 8. The guide wall 42 disposed closer to the take-out location is aligned with the stops 31 of support 1 for the front end of supply magazine 3, so as to avoid any obstruction also in this area. The end of slideway 8 facing away from entry opening 2 is completely open so as to facilitate the insertion of the full supply magazines 3. This permits the magazines 3 to be inserted into trough-shaped slideway 8 from above and/or from the rear. The latter is of particular importance when two or more magazine assemblies are disposed above one another, for instance when bottles are to be simultaneously supplied with neck and body labels. For facilitating the charging operation, slideway 8 as well as any supply feed devices of different construction may selectively be disposed at opposite sides of support 1. In addition, the rear end portion of support 1 may be provided with a further guide member 62 for preventing supply magazines 3 from being angularly displaced and for reliably guiding supply magazine 3 into exit opening 7 on its ejection.

As shown in the embodiment of FIG. 1, slideway 8 is further provided with a pair of pushers 27 non-rotatably mounted for longitudinal displacement on respective rods 63 disposed laterally of each guide wall 42. Rods 63 themselves are rotatably mounted and operatively connected to a respective rotary piston motor 29 each, the latter being operable to rotate the respective rod by an angle of about 90% and to fixedly retain it in its two end positions. In one of the angular end positions of rods 63, pushers 27 extend over the respective guide wall 42 and into slideway 8 for engagement with the rear side of supply magazines 3. In the other end position, as indicated by phantom lines in FIG. 2, pushers 27 are completely retracted from slideway 8 out of the path of supply magazines 3 and the labels contained therein. Secured to each pusher 27 is a cable extending over a return pulley 64 mounted on the end of the respective rod 63 adjacent support 1, and from there back to a cable drum 65 to which it is secured. The two cable drums 65 are secured to a common shaft 66 rotatably mounted adjacent the open rear end of slideway 8 and operatively connected to a motor 26. Motor 26 is operable to simultaneously move the two pushers 27 in the feed direction, i.e. towards support 1. The return movement in the opposite direction is accomplished with the aid of spring elements 67.

In one of their end positions, pushers 27 project a short distance into support 1, or entry opening 2, respectively, so that the last supply magazine 3 on slideway 8 is reliably introduced into support 1 to the position defined by cam members 13.

The described slideway 8 is separated from support 1 by a narrow joint and mounted independently thereof on a column 68. It does thus not participate in the short-stroke longitudinal displacement of main magazine 16 and support 1 for the control of the label take-out operation. If the control of the label take-out operation is accomplished in a different manner, for instance by varying the orbit of transfer plates 47, slideway 8 may of course be fixedly connected to support 1.

Mounted at a rear end portion of main magazine 16 is a sensor 38. for instance in the form of a reflex light barrier responsive to the presence of labels 48. As soon as sensor stops to sense the presence of labels, it generates a signal to indicate that the supply magazine 3 previously introduced into support 1 is completely empty, i.e. that the rear end of the label stack has reached the rear end of main magazine 16. In the case for instance of manual operation of the assembly, this signal may actuate a warning device calling for the attention of the operator. In a rear end portion of support 1 there is provided a limit switch 39 for generating a signal when main pusher 33 assumes its rear end position as shown in FIG. 1. In this end position, main pusher 33 is maintained at a certain spacing from the rear end of the supply magazine 3 in support 1, so that it does not interfere with the replacement of the supply magazine by a new one. A further limit switch 40 mounted at the rear end portion of mounting 1 is responsive to a supply magazine 3 when it assumes its take-out position as defined by cams 13. A further sensing element 41 is finally mounted on slideway 8 for sensing the presence of full supply magazines 3 on slideway 8. This sensing element 41 may for instance be in the form of a light barrier extending obliquely across bottom plate 19.

Figure 12:
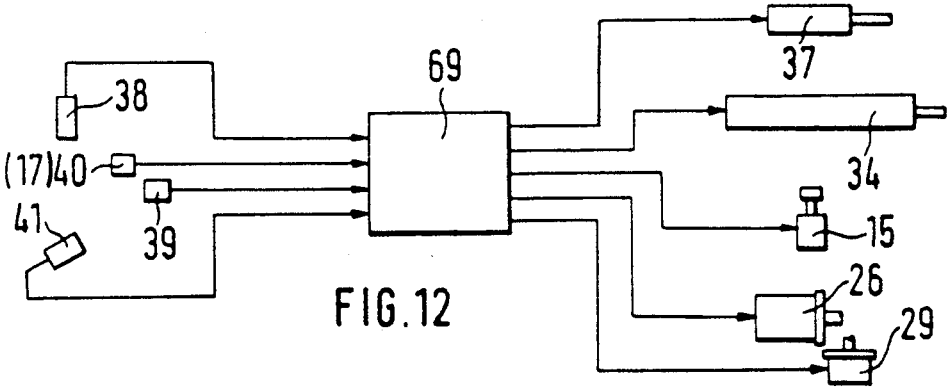
FIG. 12 is a block diagram of a control circuit for automatically carrying out the replacement operation.

Sensor 38, the two limit switches 39 and 40, and sensing element 41 are connected to a control circuit 69 (FIG. 12) operable to automatically control the replacement from the supply magazine 3 without interruption of the label feed and take-out operation. The replacement operation is initiated by a signal of sensor 38 after the supply magazine 3 in support 1 has been emptied. In a first step, pneumatic cylinder 37 is operated to pivot the two blades of auxiliary pusher 32 from the neutral position indicated by phantom lines in FIG. 4 to a position in the feed path of labels 48, whereupon pneumatic cylinder 34 is operated to advance auxiliary pusher 32 from its rearward end position at the rear of main magazine 16 into engagement with the rear end of the label stack (FIG. 1). The label feed operation is now taken over by auxiliary pusher 32 under the action of pneumatic cylinder 34. Motor 56 is then operated to retract main pusher 33 to its rear end position against the force of spring-loaded sheave 36 acting thereon. The conclusion of this operation is confirmed by limit switch 39. Subsequently actuators 15, for instance pneumatic cylinders, are operated to retract cams 13 for a short instant, and simultaneously motor 26 operates to advance pushers 27 in the feed direction. As a result, the full supply magazine 3 disposed immediately in front of entry opening 2 is pushed into support 1, whereby the empty supply magazine 3 is ejected from support 1 through exit opening 7. There is thus no separate actuating means for ejecting the empty supply magazine. The cams 13 are again raised before the empty supply magazine 3 has been completely ejected. This results in the empty supply magazine being lifted for a short instant. This short lifting of the empty magazine does not interfere with the ejection operation, but does accelerate the ejection. It is important that the cams 13 project into the exit opening 7 prior to the arrival of the full supply magazine 3 in its operative position, whereby cams 13 are effective to stop the advance of the full supply magazine and to accurately align the full magazine in its transfer position in support 1. Then motor 26 is stopped. This motor is preferably a pneumatic motor, so that there is no danger of damage even when stopped for an extended period under pressure. The fixation of the newly introduced supply magazine 3 on the side of entry opening 2 is alone due to its own weight or to the blocking effect, respectively, of further full supply magazines 3 supported on slideway 8 in contact therewith. Motor 56 is now rotated in the opposite direction, permitting spring-loaded sheave 36 to advance main pusher 33 into engagement with the rear end of the label stack in the newly introduced supply magazine 3, whereupon the further feed operation is taken over by the main pusher. Pneumatic cylinders 37 and 34 are operated to laterally retract the blades of auxiliary pusher 32 from the feed path and for returning auxiliary pusher 32 to its starting position. This concludes the magazine replacement operation without requiring any intervention by the operator. During the introduction of supply magazine 3 which has served as a shipping container on the way from the label manufacturer to the user, into support 1, flaps 46 and 52 act to prevent the labels at the front end of the magazine from dropping out. These flaps are only flipped open when main pusher 33 is operated to push the labels from supply magazine 3 into engagement with the auxiliary pusher 32, or, after its retraction, with the rear end of the label stack in main magazine 16. The supply magazine 3 is prevented from participating in this longitudinal movement by the engagement of its front edges with the stops 31 of the lateral guide rails 50. Bottom flap 46 in its opened state subsequently reposes on the two bottom guide rails 50, thus ensuring the smooth transfer of the labels from supply magazine 3 to main magazine 16.

Control element 41 may serve for activating a warning device for advising the operator that slideway 8 has to be replenished. It may also serve for partially automatizing the replenishment of slideway 8 on termination of each replacement operation by causing pushers 27 to be angularly displaced from their operative position in engagement with a supply magazine 3 to a neutral position shown in dash-dot lines in FIG. 2, to be returned to their rear end position, in which they are returned to their operative position, and to be subsequently advanced into engagement with a further supply magazine 3. In this case, the only thing the operator has to do is to place a sufficient number of full supply magazines on bottom plate 19 at any suitable time, irrespective of the position of pushers 27. At the proper time, the above described return movement of pushers 27 will then automatically cause the newly introduced supply magazines 3 to be advanced along slideway 8.

Figure 9:
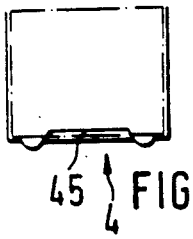
FIG. 9 is an end view of a sheet metal supply magazine for body labels.

The magazine assembly of FIGS. 6 and 7 differ from the embodiment shown in FIGS. 1 to 5 in the construction of slideway 8' for use with the supply magazine 4 of FIG. 9. As shown in FIG. 6, slideway 8' comprises a frame 70 of U-shaped cross-sectional configuration having a plurality of lateral and lower slide rails 43. The supply magazines 4 of U-shaped cross-sectional configuration are formed of sheet metal with their longitudinal ends open, their sidewalls being formed with projections 44 to be received between lateral slide rails 43. The bottom of supply magazine 4 is formed with projecting lugs 45 extending below lateral slide rails 43. In this manner the labels 48 contained in supply magazine 4 are reliably guided at the open ends of magazine 4 and thus prevented from dropping out. The supply magazines 4 are not used as shipping containers, i.e. they are only filled at the site of their employ, for instance with a label stack of suitable length held together by an adhesive strip or the like. The lower lug 45 at the side facing towards main magazine 16 is inclined upwards at a small angle, so that it can repose on bottom guide rails 50 after supply magazine 4 has been inserted into support 1. The fixation of supply magazine 4 in the longitudinal direction is again accomplished by means of the stops 31 of the two lateral guide rails 50.

The two pushers 28 of the magazine assembly of FIGS. 6 and 7 are formed as pawls biased by springs 30 to a downwards projecting operative position in which their vertical pusher faces directed in the advance direction come into engagement with the upper rim of supply magazine 4. The return movement opposite to the advancing direction causes pushers 28 to be lifted against the force of springs 30 by the engagement of their inclined rear faces with the upper edges of supply magazines 4, so that they do not exert any force on the magazines. This embodiment does thus not require specific actuator means for moving the pushers between their operative and neutral positions as in the embodiment of FIGS. 1 to 5, in which motors 29 are provided for this purpose. The two pushers 28 are each supported on two parallel guide rods 71 at respective sides of slideway 8'. Their lower ends are connected to respective endless toothed belts 72 the rear return pulleys of which are mounted on a shaft 66 driven by motor 26. The forward return pulleys are mounted for idle rotation adjacent main magazine 16 or support 1, respectively. In this manner, motor 26 may be operated to synchronously displace pushers 28 in the advance and return directions.

Figure 10:
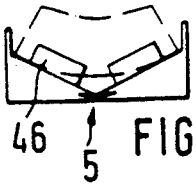
FIG. 10 is an end view of a cardboard supply magazine for neck labels.

The magazine assembly of FIGS. 1 to 5 may also be used without major modifications for supply magazines 5 containing neck labels as shown in FIG. 10. The only modification required is the adaptation of the cross-sectional shape of main magazine 16 and label pushers 32 and 33 to the shape of the labels. The supply magazines 5 are made of cardboard with their bottom folded to a channel configuration and their end portions subsequently joined. The two end portions are formed with flaps 46 for retaining the labels during shipping and insertion of the magazine 5 into support 1.

Figure 11:
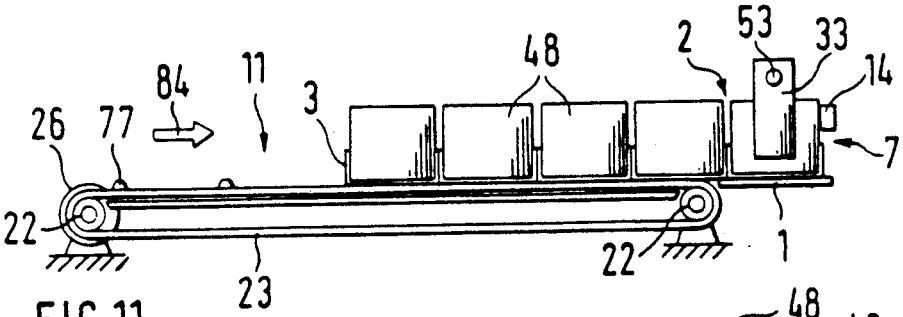
FIG. 11 is a partial elevational view of an endless belt mechanism suitable for use as the magazine supply feed device of the assembly of FIG. 1.

FIG. 11 shows an endless belt mechanism which can be used as the magazine supply feed device for the assembly of FIGS. 1-5. The mechanism includes a feed path 11 having a pair of parallel endless belts 23 extending in the advance direction between return pulleys 22, only one set being shown. Belts 23 terminate immediately in front of support 1, permitting the latter to be longitudinally displaced in unison with main magazine 16 for controlling the label take-out operation. Return pulleys 22 may all be mounted for idle rotation. In this case, additional pushers (not shown) or the like are required for advancing the full supply magazines 3, belts 23 being effective to reduce the force required for the advance movement. Alternatively, the rear return pulleys 22 may be operatively connected to motor 26, so that the latter is operable to drive belts 23 for advancing the supply magazines 3 thereon. The outer surfaces of belts 23 may be smooth so as to have a low friction coefficient. In this case accurate control of motor 26 is not required, because belts 23 are capable of sliding below supply magazines 3. Alternatively belts 23 may be provided with engagement projections 77 as indicated at the left in FIG. 11. In this case accurate control of motor 26 is required unless a slip clutch is provided between motor 26 and driven return pulleys 22.

Figure 14:
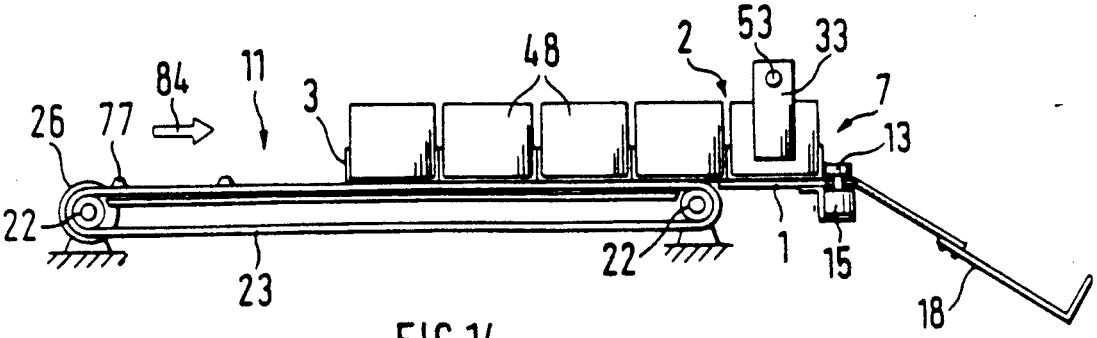
FIG. 14 is a partial elevational view of another embodiment of an endless belt mechanism as the magazine supply feed device of the assembly of FIG. 1.

Alternatively, and as shown in FIG. 14, in lieu of a guide rail 14, two cam stops 13 (only one of which is shown) can be provided adjacent exit opening 7 for lateral engagement with a supply magazine 3 that are adapted to be retracted to a position below the bottom of support 1 by means of an actuator 15 in the same manner as the cams 13 are used in the embodiment of FIGS. 1-5.

The above described magazine assemblies are basically operable in two different modes:

(a) the replaceable supply magazines are made for instance of cardboard or plastic sheeting in the form of shipping containers already filled with labels at the label manufacturer's plant. In this case the replenishment of the assembly with labels requires a very short time, as the operator merely has to remove the filled supply magazines from an outer packing, for instance a cardboard box, and to place them on the supply feed path.

(b) the supply containers are made for instance of sheet metal and are only filled at the user's plant with labels supplied in a conventional packing. In this case the packing containers for shipping may be of any type strictly selected for economical reasons.

In case (a) it is possible that the supply magazines are of different lengths, depending on the type of labels. The operator then has to take care that the supply magazines are placed on the supply feed path with their take-out ends as closely as possible to the respective guide wall 42 (See FIG. 1). The rear guide wall 42 may also be mounted in a simple manner for adjustment transversely of the advance direction, possibly in unison with the associated pusher 27 and its drive and control means.

Figure 13:
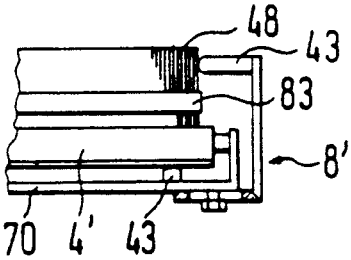
FIG. 13 is a partial view of the magazine supply feed device of FIG. 6 modified to accommodate a modified form of the magazine of FIG. 9.

In case (b) it is preferred that the length of the label stacks supplied by the manufacturer corresponds to the length of a supply magazine so as to facilitate the filling of the supply magazine and to make full use of its capacity. During shipping the labels are preferably held together by an adhesive strip or a shrink foil envelope. A suitable supply magazine 4' for employ in this case is shown in FIG. 13. The supply magazine 4' shown is relatively low, so that an adhesive strip 83 employed for holding the labels 48 together during shipping can be readily removed by the operator after the label stack has been inserted into the supply magazine 4'. For adaptation to label stacks of different lengths supply magazine 4' may be provided with an adjustable rear end wall or a replaceable insert. Another possibility consists in mounting at least one of the lateral guide rails 43 of slideway 8' for adjustment transversely of the advance direction. The simplest method, however, for the compensation of different lengths of the label stacks provides for the operator to fill the void at the rear of a label stack inserted into the supply magazine 4' with loose labels held at the ready for this purpose.

For better understanding, the feed direction of labels 48 is indicated in the drawings by an arrow 59, and the advance direction of supply magazines 3, 4, 5, 4', by an arrow 84. The invention is of course not restricted to the above described embodiments of a magazine assembly. It is thus possible that the cams 13 are fixedly mounted, in which case the actuators 15 may engage the bottom of the respective supply magazine 3 to lift the magazine a short distance so that it can slide over the cams 13 during its ejection. Furthermore support 1 may be provided with means for laterally fixing the supply magazines 3, in the shape for instance of a stepped portion adjacent entry opening 2, so that the supply magazines 3 drop to a slightly lower level as they enter support 1. The various stops may also be designed in the manner of ratchet pawls.

I claim:

1. A magazine assembly for supplying labels to a labeling machine comprising a main magazine for holding a supply of labels in a stack, first feed means for feeding the labels from the main magazine to a take-out location, a support connected to the main magazine for holding a supply magazine containing a stack of labels in alignment with said main magazine, second feed means for feeding the labels from an aligned supply magazine on the support to the main magazine, said support having an entry opening along one longitudinal side thereof for receiving full replaceable supply magazines and an exit opening located on the opposite longitudinal side of the support from the entry opening for discharging empty supply magazines, a supply magazine feed device disposed adjacent said entry opening for supplying full replaceable supply magazines to said support, said feed device including a slideway extending laterally outwardly from the opening side of the support in a direction transverse to the label feed direction and the longitudinal side of the support, said slideway adapted to hold a plurlaity of full supply magazines in side-by-side and contacting relationship with one another, means for continuously feeding said full supply magazines while in said relationship along the slideway toward and onto said support in a direction transverse to the label feed direction, said magazine feeding means comprising at least one smooth, endless belt extending between return pulleys that engages with the underside of the magazines on the slideway and means for turning said belt, means for ejecting empty supply magazines from said support and stop means located on the longitudinal side of the support opposite from said opening side to arrest and align a full supply magazine on the support with the main magazine, said stop means comprising at least one vertically displaceable cam adapted to be raised above the level of said support to engage a side of a supply magazine on the support and lowered to a position below said support to permit an empty supply magazine to be ejected from said support and means for raising and lowering said cam.

2. The magazine assembly of claim 1, including 2 cams, one adjacent a front portion and one a rear portion of the supply magazine on said support.

3. The magazine assembly of claim 1, wherein the means for feeding replaceable full supply magazines through said entry opening onto said support also and simultaneously ejects an empty supply magazine located on said support through said exit opening by the pressure exerted on the empty magazine by the replacement full supply magazine.

4. The magazine assembly of claim 1, including end stops on said support that engage a forward end portion of a full supply magazine on said support to hold the supply magazine in position as the labels are fed from the supply magazine to the main magazine but that permit unhampered transverse replacement of said supply magazines.

5. The magazine assembly of claim 1, including a plurality of endless belts each engaging the undersides of the magazines on the slideway.

6. The magazine assembly of claim 1, including collector means for receiving ejected empty supply magazines adjacent said exit opening.

7. The magazine assembly of claim 1, wherein the second feed means includes a label pusher mounted for displacement in the label feed direction independent of the first feed means, said pusher feeding the labels from the supply magazine located on the support thorugh the main magazine to the take-out location until said supply magazine is empty and thereafter said first feed means feeding the labels in said main magazine to the take-out location.

8. The magazine assembly of claim 7, including a sensor located at the entrance end of said main magazine for generating a signal when the supply magazine on said support is empty to retract said label pusher.

9. The magazine assembly of claim 8, including a limit switch on said support for generating a signal when said label pusher is retracted to its initial position away from the take-out location to activate the supply magazine feeding device to replace the empty supply magazine on the support.

10. The magazine assembly of claim 9, including a limit switch on said support for generating a signal when a full supply magazine is on the support in alignment with said main magazine to activate said label pusher.

11. The magazine assembly of claim 1, including a detector on said supply magazine feed device to generate a signal in response to the presence of supply magazines on said slideway.

12. The magazine assembly of claim 1, in which said supply feed device has lateral guides for guiding said supply magazines on the slideway.

13. The magazine assembly of claim 12, wherein said guides are slide rails running the length of the slideway, said supply magazines having conforming structure on their ends cooperating with said rails.

* * * * *